United States Patent [19]

Manino

[11] 4,367,837

[45] Jan. 11, 1983

[54] TAPE MAGAZINE FEED APPARATUS FOR HEAD DRIVEN FASTENERS

[76] Inventor: Anthony P. Manino, 1185 J Chess Dr., Foster City, Calif. 94404

[21] Appl. No.: 143,887

[22] Filed: Apr. 25, 1980

[51] Int. Cl.[3] ..... B65H 17/40

[52] U.S. Cl. ..... 227/136; 81/434; 226/52; 226/62; 227/120

[58] Field of Search ..... 81/434; 226/52, 62, 226/57, 63, 64, 65, 66, 67, 68, 69, 70, 71, 72, 73; 227/120, 136; 206/347

[56] References Cited

U.S. PATENT DOCUMENTS

| | | | |
|---|---|---|---|
| 354,462 | 12/1886 | Copeland | 206/345 |
| 2,982,595 | 5/1961 | Rogers, Jr. | 227/136 |
| 3,543,987 | 12/1970 | Obergfell et al. | 227/136 |
| 3,550,831 | 12/1970 | Obergfell | 227/136 |
| 3,554,246 | 1/1971 | Halstead | 227/136 X |
| 3,623,646 | 11/1971 | Cast et al. | 227/136 |
| 3,717,294 | 2/1973 | Green | 227/136 X |
| 3,910,324 | 10/1975 | Nasiatka | 226/62 X |
| 3,971,421 | 7/1976 | Damratowski | 81/434 |
| 3,982,678 | 9/1976 | Olson | 227/136 X |
| 4,014,225 | 3/1977 | Lejdegård et al. | 81/434 |
| 4,014,488 | 3/1977 | Potucek et al. | 226/62 X |
| 4,146,071 | 3/1979 | Mueller et al. | 227/136 X |
| 4,203,335 | 5/1980 | Coffey | 226/62 X |

FOREIGN PATENT DOCUMENTS

| | | | |
|---|---|---|---|
| 2541046 | 3/1977 | Fed. Rep. of Germany | 81/434 |
| 1187747 | 4/1970 | United Kingdom | 227/136 |
| 1429455 | 3/1976 | United Kingdom | 227/136 |

*Primary Examiner*—Paul A. Bell
*Attorney, Agent, or Firm*—Robert W. Dilts

[57] ABSTRACT

Apparatus including a tape magazine for elongated fasteners and a mechanism for feeding such fasteners in front of a driving means for driving the fasteners into a workpiece. An embodiment comprising an attachment for an electric drill in which screws are carried by the tape from the magazine into the mechanism for feeding in front of a screwdriver rotated by the electric drill is described in detail. The conformation of the tape and the tape indexing means provides jam-proofing and double feed prevention features in addition to reducing the driving force required and enabling the tape to be reloaded for reuse.

6 Claims, 9 Drawing Figures

TAPE MAGAZINE FEED APPARATUS FOR HEAD DRIVEN FASTENERS

TECHNICAL FIELD

This invention relates generally to devices in which a plurality of elongated fasteners each having a driving head at one end are carried by a tape in an aligned row for feeding in turn in front of a driving means and more particularly to such a device in which the fasteners are fed in turn directly from the tape into a driving channel for guiding the driving means and the fastener which is driven thereby, the tape being advanced by the action of the driving means and the fasteners being released from the tape without damage to the tape or contact of the tape with the driving means.

BACKGROUND ART

Devices for driving fasteners fed from a magazine one at a time in front of a mechanical, electrical, hydraulic or pneumatic driving means have long been known. It is also known in the prior art to feed the fasteners in front of the driving means from a magazine by connecting the fasteners to each other in a strip which is mounted in the magazine. However, the indexing of the strip and the separation of the fasteners from the strip for driving have presented problems and a number of different solutions have been proposed, none of which have been entirely satisfactory.

For example, it has been proposed to provide a separate shifting mechanism or device which removes the fasteners from the strip at a point spaced from the driving channel and carries them into the driving channel. U.S. Pat. No. 354,462, issued Dec. 14, 1886 to C. W. Copeland; U.S. Pat. No. 2,982,595, issued May 1, 1961 to C. E. Rogers, Jr.; and U.S. Pat. No. 3,623,646, issued Nov. 30, 1971 to Adolph Cast are representative of this solution to the problem. However, it will be understood that the shifting mechanism must be operated by the means for driving the fasteners thus extracting power from the driving action and adding an additional mechanism subject to jamming in operation.

It has also been proposed in the prior art to connect the fasteners to each other by means of a friable strip or tape which is shorn or fragmented by the driving means during the driving stroke to separate the driven fastener therefrom. U.S. Pat. No. 3,554,246 issued Jan. 12, 1971 to Donald B. Halsted, is representative of this solution to the problem. However, the fragments of the strip or tape tend to interfere with the driving operation since they are either thrown onto the surface of the workpiece where they may pass underneath the fastener being driven, or they are retained in the driving mechanism where they may cause jamming.

Finally, it has been proposed in the prior art to connect the fasteners to each other by means of a strip or tape having fastener gripping portions designed to flex when contacted by the driving means during the driving operation to cause the release of a fastener for driving. U.S. Pat. No. 3,543,987, issued Dec. 1, 1970 to Allen R. Obergfell et al.; U.S. Pat. No. 3,550,831, issued Dec. 29, 1970 to Allen R. Obergfell et al.; and U.S. Pat. No. 3,971,421, issued July 27, 1976 to H. E. Damratowski are representative of this solution to the problem. However, the basically contradictory requirements that the tape and mechanism provide a secure connection of the fasteners to the tape for storage and positioning and yet allow the driven fastener to be separated from the tape by the driving means without damage to the tape or jamming of the mechanism makes this solution to the problem difficult and of marginal effectiveness.

The present invention is directed to overcoming one or more of the problems as set forth above.

DISCLOSURE OF THE INVENTION

In one aspect of the present invention, apparatus for driving elongated fasteners into a workpiece is provided which includes in combination a flexible tape carrying such fasteners and a driving tool for driving the fasteners. The flexible tape has a plurality of grooves across one surface thereof. The driving tool includes a foot member, a driving channel extending through the foot member, a drive rod movable back and forth in the drive channel, a feed channel extending through the foot member transversely of and tangentially to the drive channel, an opening between the driving channel and the feed channel, and an indexing means for moving the flexible tape through the feed channel. A first portion of the feed channel from one end thereof to the elongated opening as well as the elongated opening have a generally rectangular cross-section with long dimensions larger than the length of the fasteners and short dimensions larger than the width of the fasteners, the feed channel being adapted to pass the tape throughout. Upon reciprocation of the drive rod in the driving channel, the indexing means is adapted to serially engage the grooves in the tape and reciprocate therealong with a component of motion in one direction which is longitudinal of the feed channel.

One subcombination of the present invention is a driving tool in which the first portion of the feed channel is positioned with respect to the remainder of the feed channel to form an included angle therebetween on the opposite side thereof from the driving channel which is less than one hundred degrees with its vertex at the opening into the driving channel.

Another subcombination of the present invention is a flexible tape having first and second pluralities of grooves formed in one surface thereof and a third plurality of grooves formed in the other surface thereof. The first plurality of grooves are each adapted to receive and hold the body of a fastener, each of the second plurality of grooves is located between a different adjacent pair of the first plurality of grooves and each of the third plurality of grooves is located in alignment with a different one of the second plurality of grooves.

In apparatus for tape feeding of fasteners in front of a driver, it is necessary that the fasteners be firmly held by the tape and yet be easily releasable for driving. Since any force required to release the fasteners from the tape must come from the driving action, it is desirable to reduce such required force toward minimum. It would also be desirable to be able to reuse the tape and to this end the tape must not come into contact with the driver and must be easy to reload with fasteners. This invention provides an improved tape and tape feeding mechanism for use in combination based on the above considerations. According to this invention, the force for indexing the tape and releasing the fasteners need not add to the force required to drive the fasteners. Double feed and anti-jam characteristics are inherent in mechanism and the fasteners are firmly held by the tape during normal handling which may include substantial flexing of the tape.

BRIEF DESCRIPTION OF THE DRAWING

This invention will be more fully understood from a reading of the following detailed description of a preferred embodiment thereof with reference to the appended drawing wherein.

BEST MODE FOR CARRYING OUT THE INVENTION

Figures 1, 2:
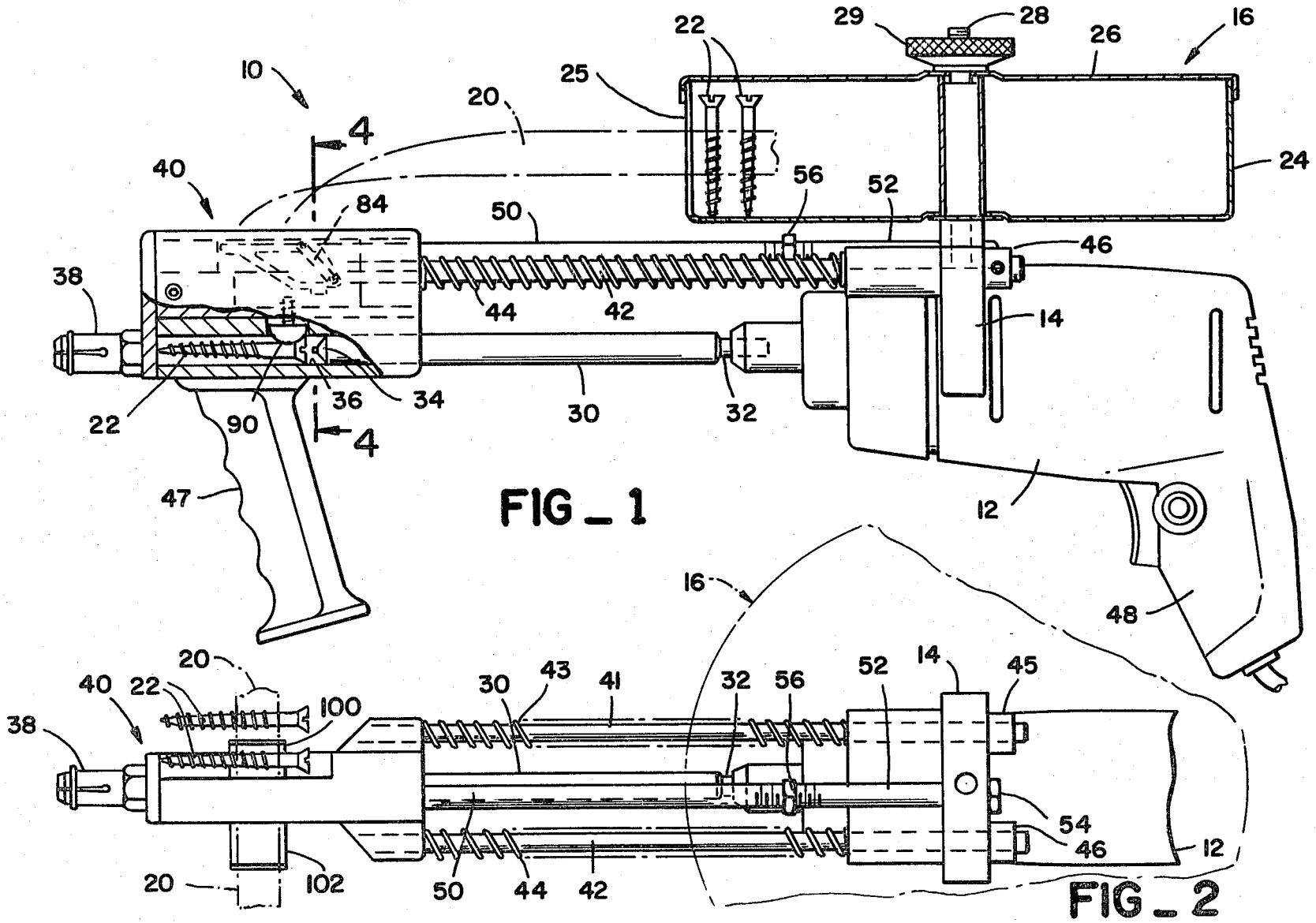
FIG. 1 is a side view in elevation of a preferred embodiment of this invention with the tape magazine thereof shown in cross-section, the tape being indicated schematically by dot dash lines and a portion of the driving foot being broken away with certain elements shown in dotted lines to enhance understanding.
FIG. 2 is a fragmentary top plan view of FIG. 1 with the tape magazine shown in phantom.

Referring to FIG. 1, an embodiment 10 according to the best mode contemplated for carrying out this invention is shown in side elevation in combination with a conventional hand-held electric drill 12. This embodiment 10 is mounted on the drill 12 by means of a yoke 14 which is rigidly fixed to the housing of the drill 12 by screws or other appropriate means. A magazine or canister 16 and a foot member 40 according to this invention are carried by the yoke 14.

The magazine 16 is adapted to contain a flexible strip 20 bearing a plurality of fasteners 22 according to this invention in a coiled roll. Thus, the magazine 16 comprises a cylindrical cup member 24 having a centrally apertured bottom and a slot 25 through the side wall thereof to pass the flexible tape 20 and fasteners 22 carried thereby. The magazine 16 is provided with a centrally apertured cap or cover plate 26 and is mounted on the yoke 14 by means of a threaded stud 28 passing through the apertures in the bottom of the cup member 24 and cover plate 26. A knurled nut 29 adapted to be threadedly engaged with the stud 28 provides for the easy removal and replacement of the cover plate 26 and/or cup member 24.

In the embodiment shown in FIG. 1, the fasteners 22 to be driven by the apparatus are conventional screws having a head with a slot or kerf. Thus a drive rod 30 is provided having a shank 32 at one end adapted to be received in the chuck of the drill 12 and a tip 34 at its other end adapted to engage the kerf in the head of the fasteners 22.

The tip 34 of the drive rod 30 is received in the driving channel 36 of a foot member 40. The foot member 40 is mounted on the yoke 14 by means of a pair of spring-loaded carrier rods 41 and 42. The carrier rods 41 and 42 are rigidly fixed at one of their ends to the foot member 40. The other ends of the carrier rods 41 and 42 are received through passageways in the yoke 14 with a sliding fit. A first helical compression spring 43 surrounds carrier rod 41 and a second helical compression spring 44 surrounds carrier rod 42. The compression springs 43 and 44 bear against the foot member 40 at one end and against the yoke 14 at the other. The free ends of the carrier rods 41 and 42 which project through the passageways in the yoke 14 are provided with adjustable stop collars 45 and 46.

The compression springs 43 and 44 are dimensioned so that they will be maintained under compression when the stop collars 45 and 46 abut the yoke 14 and the tip 34 of the drive rod 30 is fully retracted in the driving channel 36 of the foot member 40. This is the condition of the apparatus depicted in FIGS. 1 and 2, and is the idling or normal condition of the apparatus when not in use. The foot member 40 is preferably provided with a hand grip 47 and in the normal or idling condition of the apparatus the spacing between the hand grip 47 and the hand grip 48 normally provided on a conventional electric drill will be at a maximum.

The exit end of the drive channel 36 is provided with an expandable nozzle 38 adapted to grip the body of a fastener 22 and yet expand to pass the enlarged head of the fastener 22. Thus, assuming there is a fastener 22 in the drive channel 36 as shown in FIG. 1, such fastener may be driven by first actuating the drill 12 as by means of a conventional trigger switch associated with the hand grip 48 thereof, or other conventional means. The expandable nozzle 38 is then placed against the workpiece into which the fastener 22 is to be driven and the drill 12 is pushed toward the foot member 40 against the resistance of the compression springs 43 and 44. The carrier rods 41 and 42 will slide through the passageways in the yoke 14 projecting therefrom and at the same time the drive rod 30 will move along the drive channel 36 in the foot member 40 engaging the fastener 22 and forcing it out of the nozzle 38. The tip 34 of the drive rod 30 will engage the kerf in the head of the fastener 22 to impart rotational movement to the fastener 22 and drive it into the workpiece. When the fastener has been forced fully out of the nozzle 38, the foot member 40 and drill 12 may be moved apart assisted by the compression springs 43 and 44 until the stop collars 45 and 46 again abut the yoke and the tip 34 of the drive rod 30 is fully retracted in the drive channel 36.

According to this invention, a plurality of fasteners 22 are carried by tape 20 into the foot member 40 for feeding one at a time into the drive channel 36. Thus the foot member includes an indexing means designed to cooperate with the tape 20 according to this invention in feeding the fasteners 22 into the drive channel 36.

As best shown in FIGS. 1 and 2, the indexing means according to this invention is operated by an actuating rod 50 which extends between the foot member 40 and the yoke 14. One end 52 of the actuating rod 50 is received through a passageway in the yoke 14 with a sliding fit and is provided with a head 54 adapted to abut the yoke and provide a stop means corresponding to the stop collars 45 and 46. The other end of the actuating rod 50 is operatively connected to the indexing means. An actuating nut 56 is threadedly mounted on the actuating rod 50 intermediate its ends and is positioned to be contacted by yoke 14 during the course of the fastener driving stroke of the apparatus. Thus, when a fastener 22 in the driving channel 36 has been at least partially driven into a workpiece, the yoke 14 will come into contact with the actuating nut 56 and will force the actuating rod 50 to move longitudinally with respect to the foot member 40 to actuate the indexing means according to this invention through a portion of its cycle. After the fastener 22 has been fully driven into the workpiece and the foot member 40 and drill 22 are moved apart, the yoke 14 will come into contact with the head 54 of the actuating rod causing it to move longitudinally in the opposite direction and thereby actuate the indexing means according to this invention through the balance of its cycle after the tip 34 of the drive rod 30 has been sufficiently retracted in the driving channel 36.

Figures 3, 4, 4A, 4B:
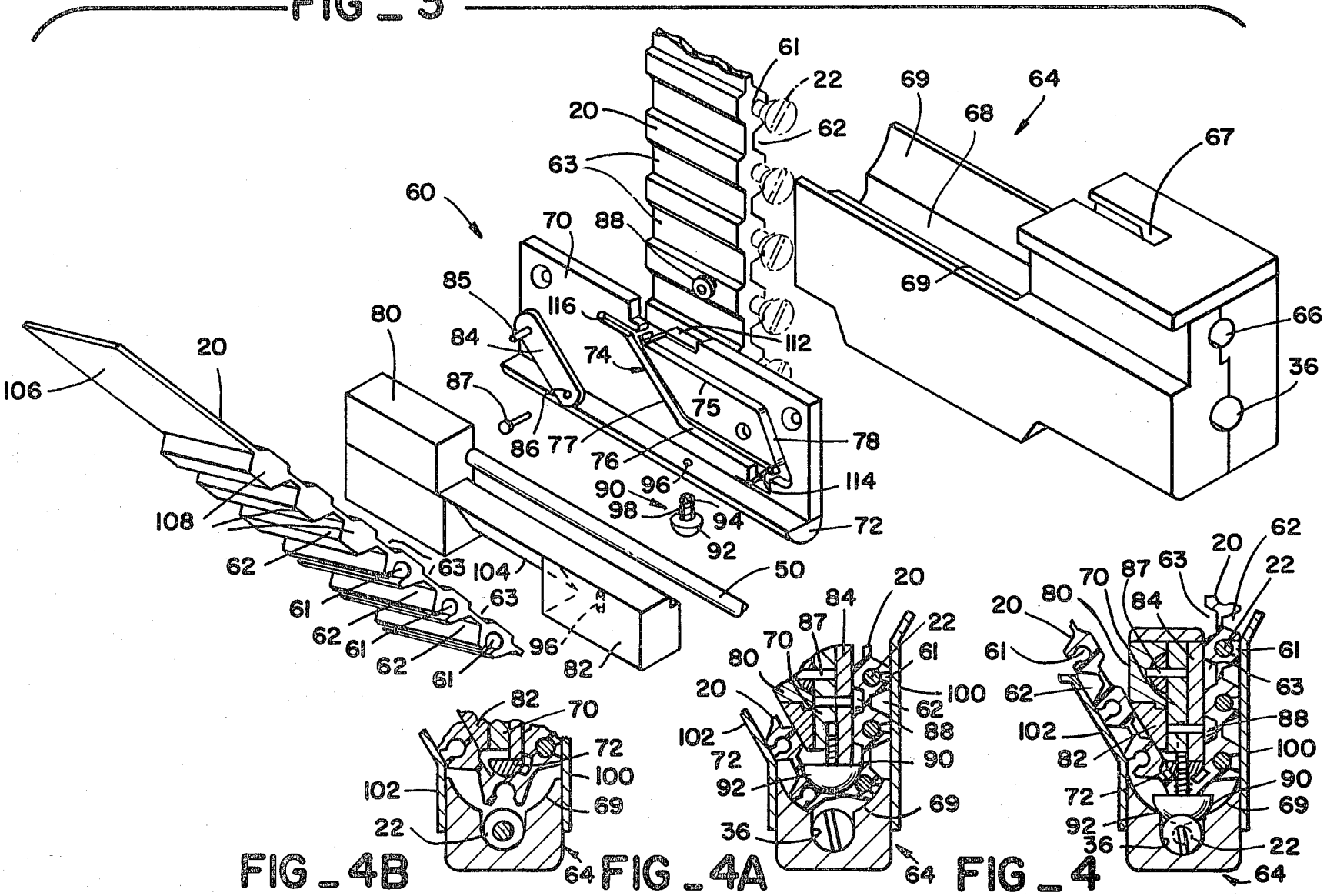
FIG. 3 is an exploded view of the tape indexing mechanism according to a preferred embodiment of this invention shown in perspective together with the tape.
FIG. 4 is a cross-sectional view taken along line 4—4 of FIG. 1 with FIG. 4A being a fragment of FIG. 4 showing the tape in an intermediate position and FIG. 4B being a fragment of FIG. 4 with the fastener positioning means omitted.

Referring to FIG. 3, an exploded view showing structural details of the tape 20 and tape indexing means 60 in perspective is given. According to this embodiment of the invention, the tape 20 has a first plurality of grooves 61 and a second plurality of grooves 62 formed across one surface thereof. The first plurality of grooves 61 are each adapted to receive and compressively hold the body of a fastener 22. Each of the second plurality of grooves 62 is interposed between a different adjacent pair of the first plurality of grooves 61. A third plurality of grooves 63 are formed across the other surface of the tape 20 in alignment with the second plurality of grooves. As will be explained more fully hereinafter, the second and third plurality of grooves enable the tape to be flexed without releasing the fasteners 22 and yet provide for the release of individual fasteners from the tape by bending or kinking the tape in a specific manner. According to this embodiment of the invention, the third plurality of grooves is adapted to cooperate with the mechanism of the tape indexing means 60 to move the tape through the foot member 40.

As shown at the right hand side of FIG. 3, a portion of the foot member 40 is provided by a driving block 64 which may be made in two halves as a matter of convenience. The driving channel 36 is formed in the driving block 64. In addition, a passageway 66 adapted to receive the actuating rod 50 with a sliding fit is provided in the driving block 64. The driving block 64 also provides an elongated opening 68 into the drive channel 36. On each side of the elongated opening 68, the driving block 64 provides arcuate surfaces 69 which form one wall of a portion of the feed channel for the tape 20.

The indexing means 60 comprises a cam plate 70 which is mounted in a slot 67 in the drive block 64 and extends over the elongated opening 68 in spaced relation to the arcuate surfaces 69. The cam plate 70 includes a half-round member 72 along its lower edge to define the portion of the feed channel opposite the arcuate surfaces 69 about which the tape 20 is sharply bent in order to release a fastener into the elongated opening 68. One side of the cam plate 70 also defines a portion of a side wall of the feed channel and the cam plate 70 has an elongated passageway 74 therethrough in the form of a closed quadrilateral loop. The closed quadrilateral loop 74 has parallel upper 75 and lower 76 sides which are also parallel to the axis of the driving channel 36 according to this embodiment of the invention. The quadrilateral loop has a driving end portion 77 and an arming end portion 78 which need not be parallel to each other, although both should extend at an included angle with respect to the axis of the driving channel 36 which is less than ninety degrees as will be more fully explained hereinafter.

The indexing mechanism also includes a slide 80 which is rigidly fixed to the end of the actuating rod 50 and is mounted on a slide member 82. The slide member 82 is adapted to be mounted on the driving block 64 and to carry the slide 80 for reciprocating movement along the opposite surface of the cam plate 70 from the surface thereof which forms a portion of the feed channel for the tape 20. A cam link 84 is mounted on the slide 80 for pivotal movement about one of its ends by means of a pin 85. The other end of the cam link 84 is provided with an aperture 86 and a cam axle 87 projects through such aperture and through the elongated passageway 74 in the cam plate. A cam roller 88 is mounted on the cam axle 87 on the opposite side of the cam plate 70 from the cam link 84. The cam roller 88 is adapted to engage and reciprocate within the slots 63 by rolling along a side thereof.

Thus the actuating rod 50 causes the slide 80 to reciprocate along the slide member 82 carrying with it the cam link 84. The cam axle 87 received in the aperture 86 of the cam link 84 follows the closed quadrilateral loop 74 of the cam plate 70 carrying with it the cam roller 88. The cam roller 88 serially engages the grooves 63 in the tape 20 to index the tape through the foot member as will be more fully described hereinafter in connection with FIGS. 5–7.

As best shown in FIGS. 1, 3 and 4, a fastener positioning means 90 is provided in the driving channel 36 in position to engage a fastener 22 in the driving channel 36 adjacent the head of the fastener 22. According to this embodiment of the invention, the fastener positioning means 90 comprises a spring loaded plunger having a mushroom shaped head 92 and a shank 94 which is received in a passageway 96 formed through the half-round member 72 and into the slide member 82. A helical compression spring is received about the shank 94 and bears at one end on the head 92 and at the other end on the surface of the half-round member 72. Such helical compression spring may be of very low force since its only function is to position the fastener 22 within the driving channel 36 against the force of gravity, thereby enabling the apparatus of this invention to be used in any position and with the driving channel extending at any angle to the horizontal.

Referring to FIG. 4, a first guide plate 100 is rigidly fixed to the driving block 64 and extends generally parallel to the cam plate 70 on the same side thereof as the cam roller 88 in order to complete the inlet portion of the feed channel. Similarly, a guide plate 102 is rigidly fixed to the driving block 64 and together with a beveled surface 104 provided on the slide member 82 defines the outlet portion of the feed channel through which the tape 20 passes after the fasteners 22 have been released therefrom.

As the tape 20 enters the feed channel and is indexed therethrough, the first fastener carried by the tape will engage the fastener positioning means 90, forcing it to move upwardly by compression of the spring 98. As the tape 20 is bent sharply about the half-round member 72 the grooves 61 will be opened to release the fastener carried thereby and the compression spring 98 will force the head 92 of the fastener positioning means against the fastener 22 in the driving channel 36.

As best shown in FIG. 3, the tape 20 is provided with a thin threading strip 106 at the starting end thereof. Also, as best shown in FIG. 3, there are no grooves 61 intermediate the first three or four grooves 62 at the starting end of the tape to receive fasteners. According to this invention, the tape 20 may be substantially flexed without releasing fasteners therefrom because of the aligned grooves 62 and 63. However, by maintaining portions of the tape 20 on each side of a given groove 61 rigidly rectilinear and bending such rectilinear portions sharply with respect to each other at the given groove 61, such groove may be caused to open and release a fastener 22 held thereby. Thus the guide plates 100 and 102 cooperate with the half-round member 72 to bend the tape 20 to form an included angle between rectilinear portions thereof which is less than one hundred degrees thereby opening a groove 61 located at the apex of such angle to freely release a fastener held thereby.

As best shown in FIG. 4A, the arcuate surface 69 of the driving block 64 adjacent the elongated opening cooperates with the tape 20 and the half-round member 72 to force a fastener 22 against the fastener positioning means as the tape 20 is moved through the feed channel. Thus the fastener positioning means 90 is raised by the fastener 22 during indexing of the tape to admit such fastener 22 to the elongated opening so that it may be released into the drive channel 36. FIG. 4B illustrates the cooperation of the grooves 62 and 63 with the half-round member 72 in opening a groove 61 to release a fastener 22.

Figure 5:
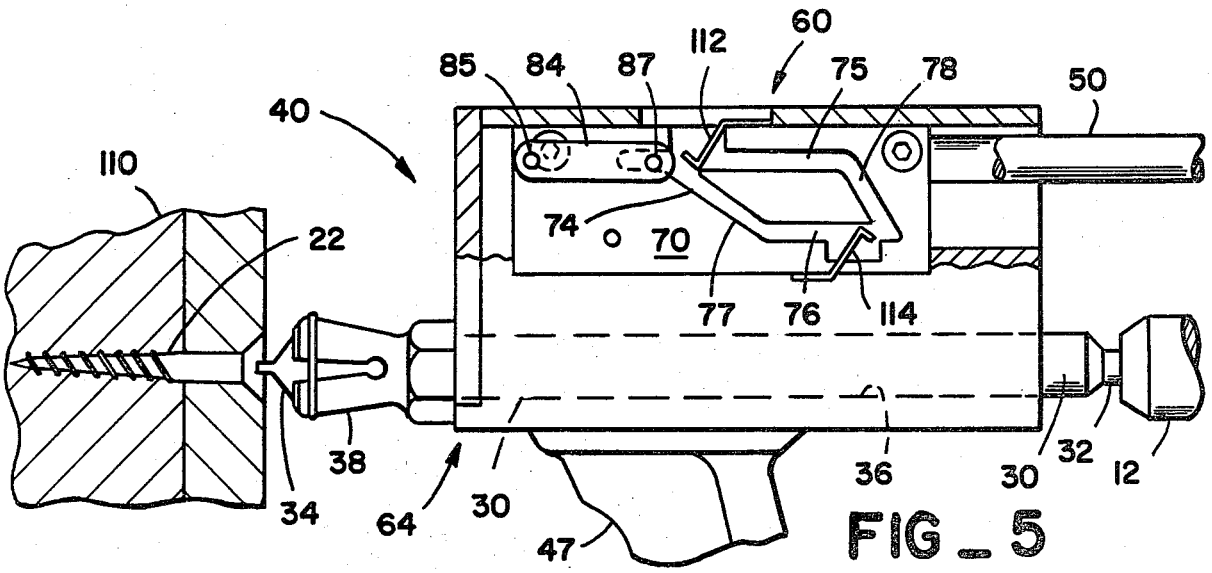
FIG. 5 is a fragmentary view partially in cross-section, showing the driving foot with the elements thereof in their positions at the conclusion of the driving of a fastener.
Figure 6:
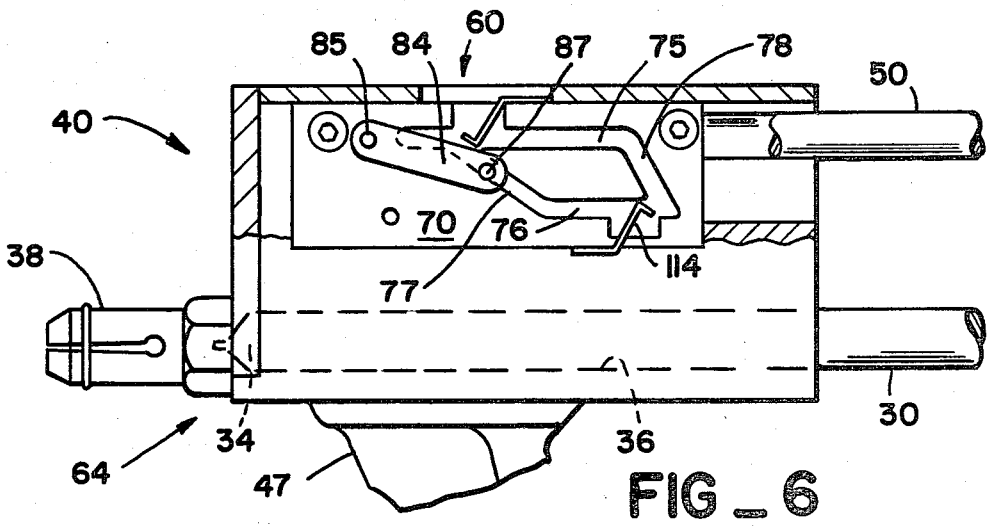
FIG. 6 is a view similar to FIG. 5 but showing the elements of the driving foot at an intermediate position in which the tape is being indexed to move another fastener into position for driving.
Figure 7:
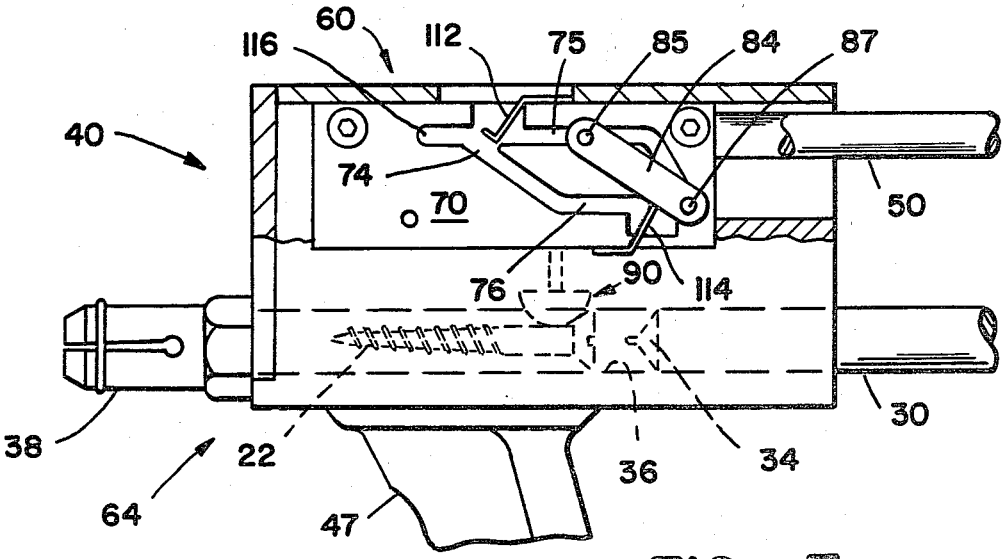
FIG. 7 is a view similar to FIG. 6 but showing the elements of the driving foot in their idling position at the end of the indexing of the tape and immediately prior to a further driving stroke.

Referring to FIGS. 5, 6 and 7, the operation of the indexing means 60 according to this embodiment of the invention is illustrated. Thus in FIGS. 5–7 the slide 80, slide member 82 and the end of the actuating rod associated therewith have been omitted in order to show the cam plate 70 and cam link 84 in side elevation. The driving channel 36 in the driving block 64 and a portion of the drive rod 30 received therein are indicated in phantom.

In FIG. 5, the drive rod 30 and cam link 84 are shown in their positions relative to the foot member 40 upon completion of the driving of a fastener 22 into a workpiece 110. In FIG. 7, the drive rod 30 and cam link 84 are shown in their normal or idling positions relative to the foot member corresponding to their positions in FIGS. 1 and 2. In FIG. 6, the drive rod 30 and cam link 84 are shown in intermediate positions relative to the foot member as they travel from their positions shown in FIG. 5 to their positions shown in FIG. 7.

From FIGS. 5, 6 and 7 it will be seen that a leaf spring member 112 projects into the quadrilateral passageway 74 at the upper left hand corner thereof to engage the cam axle 87 and deflect it into the driving end 77 of such quadrilateral passageway 74. It will be understood that the leaf spring member 112 will allow the cam axle 87 to move from right to left in the upper side 75 of the quadrilateral passageway 74 but once it has passed under the leaf spring member 112 by deflecting it upwardly, the cam axle 87 cannot reenter the upper side 75 of the quadrilateral channel 74 from the left but must enter the driving end 77 of the quadrilateral channel.

Similarly, a leaf spring member 114 is located at the lower right hand corner of the quadrilateral channel 74. The leaf spring member 114 will pass the cam axle 87 from left to right in the lower side 76 of the quadrilateral channel 74 but will prevent the cam axle 87 from entering the side 76 from the right and will deflect the cam axle 87 into the arming end 78 of the quadrilateral channel 74. Thus, the spring members 112 and 114 will prevent indexing of the tape 20 to feed a further fastener into the driving channel 36 until the previous fastener 22 has been forced entirely out of such driving channel 36 through the nozzle 38. In this regard, it is noted that the upper side 75 of the quadrilateral passageway 74 is provided with an appropriate extension 116 in order to provide some leeway in the amount of movement of the driving rod 30 in the fastener driving direction.

The operation of the indexing means 60 may be best understood beginning with FIG. 7 which is the normal or idling position of the mechanism. As the drive rod 30 is forced into the drive channel and against a fastener therein, the fastener 22 will be forced into the nozzle 38. At about this point, the actuating nut 56 on the actuating rod 50 will be engaged by the yoke 14 and moved from right to left carrying with it the slide member 80 and the cam link 84. As the cam link 84 is moved from right to left from its position shown in FIG. 7, the cam axle 87 will move upwardly in the arming end 78 of the quadrilateral passageway 74 and will enter the upper side 75 thereof. Thus, the cam axle 87 will carry the cam roller upwardly and then across the tape through one of the grooves 63 as the fastener 22 is being driven into the workpiece 110.

When the fastener 22 is fully driven into the workpiece 110, the cam link 84 will be in the position shown in FIG. 5 and the cam roller 88 carried by the cam axle 87 will be received in a groove 63 on the tape 20 at the forward end thereof, the cam axle having passed under the leaf spring member 112.

As the drive rod 30 is retracted, the yoke 14 on the drill 12 will engage the head 54 of the actuating rod, moving it from left to right with respect to the driving foot 40 and carrying with it the slide 80 and the actuating link 84. As the actuating link 84 moves from left to right it will be deflected into the driving end 77 of the quadrilateral loop 74 pivoting the cam link 84 in a downward direction, forcing the cam roller 88 against the side of the groove 63 thereby forcing the tape 20 to move into the feed channel. The quadrilateral loop 74 is dimensioned so that the length of the driving end 77 thereof will be sufficient to move the tape 70 by the distance necessary to locate the next fastener carried by the tape over the elongated opening between the feed channel and the drive channel 36. The cam axle 87 will then enter the lower side 76 of the quadrilateral channel, at which point the cam roller 88 will be removed from engagement with a groove 63 in the tape 20. When the drive rod 30 has been fully retracted, the actuating rod will have moved the cam link 84 to its position shown in FIG. 7 in which the cam axle 87 has passed the leaf spring member 114 and is in its idling position ready for a further stroke.

It will be understood that the compression springs 43 and 44 on the carrier rods 41 and 42 will help in retracting the drive rod 30 and actuating rod 50 from their positions shown in FIG. 5 to their positions shown in FIG. 7. However, it will also be convenient for the operator to apply force between the grip 47 on the foot member 40 and the grip 48 on the drill 12 tending to force them apart. Thus it is not necessary that the compression springs 43 and 44 be capable of providing sufficient force to actuate the indexing means in order to move the tape 20 through the feed channel. In fact, it is desirable that the compression springs 43 and 44 exert no more force than is necessary to maintain the apparatus in its normal or idling position since any additional force provided by the compression springs 43 and 44 will only increase the driving force required in driving a fastener 22 into a workpiece. Thus, according to this invention, the force required to index the tape may be manually exerted at a separate time from the driving of a fastener thereby reducing the required driving force toward minimum. In addition, the indexing means according to this invention prevents double feeding of fasteners into the drive channel 36 and jamming of the apparatus is avoided by the positioning means 90. The fasteners are released from the tape through the bending of the tape and without the exertion of any force on the fasteners. The tape is not contacted by the driving means and thus may be reloaded and reused. Reloading of the tape is easily accomplished by the appropriate bending of the tape to facilitate the insertion of the fasteners and once inserted, the fasteners are firmly held by the tape even though the tape may be subjected to substantial flexure in handling.

It is believed that those skilled in the art will make obvious modifications in the preferred embodiment of this invention as shown in the drawing without departing from the scope of the following claims. For example, the passageway in the cam plate 70 need not be quadrilateral but could be triangular if appropriately dimensioned. In other words, the lower side 76 of the closed camming loop 74 may be reduced to a minimum and the arming end of the camming passageway 74 may be made to diverge from the driving end 74 so that both the driving and arming movement of the cam link occurs on the retraction stroke of the drive rod 30. Similarly, other equivalent structures may be substituted for the fastener positioning means 90 as shown in the drawing such as a leaf spring arrangement, for example. The apparatus according to the teaching of this invention may be obviously modified for use in an impact type fastener driving operation, although the preferred embodiment is for use in driving screws or similar type fasteners.

What is claimed is:

1. In a driving tool for driving fasteners into workpieces from a flexible tape having a plurality of equally spaced grooves extending transversely across one surface thereof with a plurality of said fasteners distributed along one side of said tape and extending transversely of said tape, said driving tool comprising a foot member, a driving channel extending through said foot member to an open end, a drive rod movable back and forth in the axial direction of said driving channel adapted to engage a fastener in said driving channel and move said fastener through a portion of said driving channel and out of said open end thereof, a feed channel of generally rectangular cross-section extending through said foot member transversely of and tangential to said portion of said driving channel, an elongated opening communicating between said feed channel and said drive channel with its axis of elongation extending parallel to the axis of said drive channel, said elongated opening and the cross-section of the first portion of said feed channel from one end thereof to said elongated opening having their long dimensions greater than the length of said fasteners and their short dimensions greater than the width of said fasteners, said feed channel having cross-sectional dimensions adapted to pass said tape throughout; the improvement comprising:

positioning said first portion of said feed channel with respect to the remainder of said feed channel to form an included angle therebetween on the opposite side thereof from said driving channel which is less than one hundred degrees with the vertex of said angle tangential to said driving channel and said elongated opening extending along said vertex of said angle.

2. In a driving tool for driving fasteners into workpieces from a flexible tape having a plurality of equally spaced grooves extending transversely across one surface thereof with a plurality of said fasteners distributed along one side of said tape and extending transversely of said tape, said driving tool comprising a foot member, a driving channel extending through said foot member to an open end, a drive rod movable back and forth in the axial direction of said driving channel adapted to engage a fastener in said driving channel and move said fastener through a portion of said driving channel and out of said open end thereof, a feed channel of generally rectangular cross-section extending through said foot member transversely of and tangential to said portion of said driving channel, an elongated opening communicating between said feed channel and said drive channel with its axis of elongation extending parallel to the axis of said drive channel, said elongated opening and the cross-section of the first portion of said feed channel from one end thereof to said elongated opening having their long dimensions greater than the length of said fasteners and their short dimensions greater than the width of said fasteners, said feed channel having cross-sectional dimensions adapted to pass said tape throughout; the improvement comprising:

indexing means associated with said drive rod for serially engaging each of said plurality of grooves in said one surface of said tape and reciprocating therealong with a component of motion in one direction which is longitudinal of said feed channel for indexing said tape through said feed channel upon reciprocation of said drive rod axially of said driving channel, said indexing means including a cam plate forming a part of the side wall of said first portion of said feed channel, said cam plate defining a passageway through said side wall in the form of a closed loop, and a cam follower urged to move through said closed loop upon reciprocation of said drive rod including roller means projecting into said feed channel and serially engaging each of said plurality of grooves, said closed loop including opposite parallel sides which are parallel to said plurality of grooves in said one surface of said tape within said feed channel with one end of said closed loop extending across said tape and the other end of said closed loop spaced from said tape.

3. In combination for driving elongated fasteners into a workpiece;

(a) a flexible tape having a plurality of grooves extending transversely across at least one surface thereof;

(b) a plurality of equally spaced elongated fasteners each received in a different one of said plurality of grooves in one surface of said flexible tape;

(c) a driving tool comprising a foot member, a driving channel extending through said foot member to an open end, a drive rod movable back and forth in the axial direction of said driving channel adapted to engage a fastener in said driving channel and move said fastener through a portion of said driving channel and out of said open end thereof, a feed channel of generally rectangular cross-section extending through said foot member transversely of and tangentially to said portion of said driving channel, an elongated opening communicating between said feed channel and said drive channel with its axis of elongation extending parallel to the axis of said drive channel, said elongated opening and the cross-section of the first portion of said feed channel from one end thereof to said elongated opening having their long dimensions greater than the maximum length of said fastener and their short dimensions greater than the maximum width of said fasteners, said first portion and the remainder of said feed channel having cross-sectional dimensions adapted to pass said tape throughout; and indexing means associated with said drive rod and said feed channel for serially engaging ones of said plurality of grooves in a given surface of said tape and reciprocating therealong with a component of motion in one direction which is longitudinal of said feed channel for indexing said tape through said feed channel from said one end thereof upon reciprocation of said drive rod axially of said driving channel, said first portion of said feed channel and said remainder of said feed channel being rectilinear and forming an included angle therebetween on the opposite side thereof from said driving channel that is less than about one hundred degrees with said elongated opening extending along the vertex of said angle.

4. The combination of claim 3 wherein said first portion of said feed channel and said remainder of said feed channel each have a longitudinal length which is at least about twice the spacing between adjacent ones of said plurality of fasteners.

5. The combination of claim 4 wherein the wall of said feed channel opposite said elongated opening defines a half-round surface having a diameter about equal to one-half the spacing between adjacent ones of said plurality of fasteners.

6. The combination of claim 5 wherein said flexible tape has a pair of aligned grooves each extending across a different surface of said tape intermediate each pair of adjacent ones of said plurality of elongated fasteners received on said tape.

* * * * *